US006179071B1

(12) United States Patent
Dietzen

(10) Patent No.: US 6,179,071 B1
(45) **Date of Patent: *Jan. 30, 2001**

(54) METHOD AND APPARATUS FOR HANDLING AND DISPOSAL OF OIL AND GAS WELL DRILL CUTTINGS

(75) Inventor: Gary Dietzen, Lafayette, LA (US)

(73) Assignee: M-I L.L.C., Houston, TX (US)

( * ) Notice: Under 35 U.S.C. 154(b), the term of this patent shall be extended for 0 days.

This patent is subject to a terminal disclaimer.

(21) Appl. No.: 09/260,949

(22) Filed: Mar. 2, 1999

Related U.S. Application Data

(63) Continuation-in-part of application No. 09/182,623, filed on Oct. 29, 1998, which is a continuation-in-part of application No. 09/071,820, filed on May 1, 1998, now Pat. No. 5,971,084, which is a continuation-in-part of application No. 09/039,178, filed on Mar. 13, 1998, now Pat. No. 5,913,372, which is a continuation-in-part of application No. 08/950,296, filed on Oct. 14, 1997, now Pat. No. 6,009,959, which is a continuation-in-part of application No. 08/813,462, filed on Mar. 10, 1997, now Pat. No. 5,839,521, which is a continuation-in-part of application No. 08/729,872, filed on Oct. 15, 1996, now Pat. No. 5,842,529, which is a continuation-in-part of application No. 08/416,181, filed on Apr. 4, 1995, now Pat. No. 5,564,509, which is a continuation-in-part of application No. 08/197,727, filed on Feb. 17, 1994, now Pat. No. 5,402,857.

(51) Int. Cl.[7] ..... E21B 21/06; B09B 5/00
(52) U.S. Cl. ..... 175/66; 175/206; 175/207
(58) Field of Search ..... 175/66, 206, 207; 166/267; 134/108

(56) References Cited

U.S. PATENT DOCUMENTS

| | | |
|---|---|---|
| 1,125,413 | 1/1915 | Van Doren . |
| 2,803,501 | 8/1957 | Kelly . |
| 3,400,819 | 9/1968 | Burdyn . |
| 3,433,312 | 3/1969 | Burdyn et al. . |
| 3,993,359 | 11/1976 | Sweeney . |
| 4,019,641 | 4/1977 | Merz . |
| 4,030,558 | 6/1977 | Morris . |
| 4,565,086 | 1/1986 | Orr, Jr. . |
| 4,595,422 | 6/1986 | Hill et al. . |
| 4,793,423 | 12/1988 | Knol . |

(List continued on next page.)

FOREIGN PATENT DOCUMENTS

| | | |
|---|---|---|
| 0 005 273 | 5/1979 | (EP) . |
| 2162880 | 2/1986 | (GB) . |

*Primary Examiner*—Frank Tsay
(74) *Attorney, Agent, or Firm*—Howrey Simon Arnold & White, LLP

(57) ABSTRACT

A method and apparatus for removing drill cuttings from an oil and gas well drilling platform provides for the separation of drill cuttings from at least a volume of the well drilling fluid (i.e. drilling mud) on the drilling platform so that the drilling fluids can be recycled into the well bore. The cuttings are then transferred to a cuttings collection area on the platform. The separated drill cuttings are then suctioned with a first suction line having an intake portion. The suctioned drill cuttings are transmitted to a vacuum holding tank or multiple tanks on the platform, each having a tank interior. A vacuum is formed within the holding tank interior with a blower that is in fluid communication with the tank interior via a second vacuum line. The holding tank is then connected to a floating work boat with a discharge flow line. Cuttings are then transmitted from the tank on the platform to the work boat via the flow line. In an alternate embodiment, cuttings can be transferred to an underwater storage area. In this fashion, multiple holding tanks on the drilling platform can be used to store cuttings until a work boat arrives. The work boat can be provided with its own high capacity work boat holding tank (for example 100–1000 barrels) for receiving cuttings from the multiple tanks on the drilling platform when disposal is desired. The underwater storage tank can be used in place of or as a supplement to the work boat holding tanks.

66 Claims, 15 Drawing Sheets

U.S. PATENT DOCUMENTS

| | | |
|---|---|---|
| 4,878,576 | 11/1989 | Dietzen . |
| 4,942,929 | 7/1990 | Malachosky et al. . |
| 5,016,717 | 5/1991 | Simons et al. . |
| 5,109,933 | 5/1992 | Jackson . |
| 5,190,085 | 3/1993 | Dietzen . |
| 5,322,393 | 6/1994 | Lundquist . |
| 5,341,856 | 8/1994 | Appenzeller . |
| 5,344,570 | 9/1994 | McLachlan et al. . |
| 5,564,509 | 10/1996 | Dietzen . |
| 5,662,807 | 9/1997 | Angelle . |
| 5,839,521 | 11/1998 | Dietzen . |
| 5,842,529 | 12/1998 | Dietzen . |
| 5,846,440 | 12/1998 | Angelle . |

METHOD AND APPARATUS FOR HANDLING AND DISPOSAL OF OIL AND GAS WELL DRILL CUTTINGS

CROSS-REFERENCE TO RELATED APPLICATIONS

This is a continuation-in-part of U.S. patent application Ser. No. 09/182,623, filed Oct. 29, 1998, which is a continuation-in-part of U.S. patent application Ser. No. 09/071,820, filed May 1, 1998, now U.S. Pat. No. 5,971,084, which is a continuation-in-part of U.S. patent application Ser. No. 09/039,178, filed Mar. 13, 1998, now U.S. Pat. No. 5,913,372, which is a continuation-in-part of U.S. patent application Ser. No. 08/950,296, filed Oct. 14, 1997, now U.S. Pat. No. 6,009,959, which is a continuation-in-part of U.S. patent application Ser. No. 08/813,462, filed Mar. 10, 1997, which is now U.S. Pat. No. 5,839,521, which is a continuation-in-part of U.S. patent application Ser. No. 08/729,872, filed Oct. 15, 1996, now U.S. Pat. No. 5,842,529, which is a continuation-in-part of U.S. patent application Ser. No. 08/416,181, filed Apr. 4, 1995 (now U.S. Pat. No. 5,564,509) which is a continuation-in-part of U.S. patent application Ser. No. 08/197,727, filed Feb. 17, 1994 (now U.S. Pat. No. 5,402,857), each of which is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to oil and gas well drilling and more particularly to the handling of cuttings that are generated during oil and gas well drilling activity. Even more particularly, the present invention relates to an improved vacuum tank apparatus and method for handling cuttings that are generated during oil and gas well drilling and in oil and gas exploration. Tanks are provided on an oil and gas well drilling platform and on a work boat positioned next to the platform. Both the platform and work boat have vacuum units that help transfer cuttings from the platform to the work boat.

2. General Background of the Invention

In the drilling of oil and gas wells, a drill bit is used to dig many thousands of feet into the earth's crust. Oil rigs typically employ a derrick that extends above the well drilling platform and which can support joint after joint of drill pipe connected end to end during the drilling operation. As the drill bit is pushed farther and farther into the earth, additional pipe joints are added to the ever lengthening "string" or "drill string". The drill pipe or drill string thus comprises a plurality of joints of pipe, each of which has an internal, longitudinally extending bore for carrying fluid drilling mud from the well drilling platform through the drill string and to a drill bit supported at the lower or distal end of the drill string.

Drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the surface, it is contaminated with small pieces of shale and rock which are known in the industry as well cuttings or drill cuttings.

Well cuttings have in the past been separated from the reusable drilling mud with commercially available separators that are known as "shale shakers". Other solids separators include mud cleaners and centrifuge. Some shale shakers are designed to filter coarse material from the drilling mud while other shale shakers are designed to remove finer particles from the well drilling mud. After separating well cuttings therefrom, the drilling mud is returned to a mud pit where it can be supplemented and/or treated prior to transmission back into the well bore via the drill string and to the drill bit to repeat the process.

The disposal of the separated shale and cuttings is a complex environmental problem. Drill cuttings contain not only the mud product which would contaminate the surrounding environment, but also can contain oil that is particularly hazardous to the environment, especially when drilling in a marine environment.

In the Gulf of Mexico for example, there are hundreds of drilling platforms that drill for oil and gas by drilling into the subsea floor. These drilling platforms can be in many hundreds of feet of water. In such a marine environment, the water is typically crystal clear and filled with marine life that cannot tolerate the disposal of drill cuttings waste such as that containing a combination of shale, drilling mud, oil, and the like. Therefore, there is a need for a simple, yet workable solution to the problem of disposing of oil and gas well cuttings in an offshore marine environment and in other fragile environments where oil and gas well drilling occurs.

Traditional methods of cuttings disposal have been dumping, bucket transport, cumbersome conveyor belts, screw conveyors, and washing techniques that require large amounts of water. Adding water creates additional problems of added volume and bulk, messiness, and transport problems. Installing conveyors requires major modification to the rig area and involves many installation hours and very high cost.

The following U.S. patents are incorporated herein by reference: U.S. Pat. Nos. 4,867,877; 4,255,269; 5,129,469; and 5,109,933.

BRIEF SUMMARY OF THE INVENTION

The present invention provides a method for disposal of drill cuttings from an oil and gas well drilling platform. The method includes the steps of separating the drill cuttings from substantially all of the well drilling fluid in which the drill cuttings have been conveyed from an area being drilled.

The cuttings are then transferred to a materials collection area such as a materials trough.

The drill cuttings are then transported to a holding tank using a vacuum and a first suction line.

A vacuum is generated within the holding tank using a blower so that drill cuttings are transported from the trough or collections area to the tank via a suction line.

Cuttings are then transferred from the holding tank to a work boat via a flow line. Further treatment such as recycling of drilling mud can be performed on the boat.

The drill cuttings are typically transported directly to a holding tank via a first suction line.

The vacuum is generated by a vacuum generating means or blower that is in fluid communication with the holding tank via a second suction line.

The work boat preferably provides its own holding tank of very large volume such as 100–1000 barrels. The holding tank on the work boat is likewise provided with a blower that pulls a vacuum on the tank to aid in transfer of cuttings from the holding tanks on the platform to the holding tank on the work boat.

In one embodiment, the work boat simply collects cuttings transferred to it from the drilling platform. In another embodiment, the boat is equipped with treatment units that process the cuttings. The cuttings can be slurried on one deck of the boat and then pumped for storage to another deck area on the boat. In yet another embodiment, the boat is equipped with treatment apparatus that separates and recycles drilling fluids such as more expensive synthetics.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
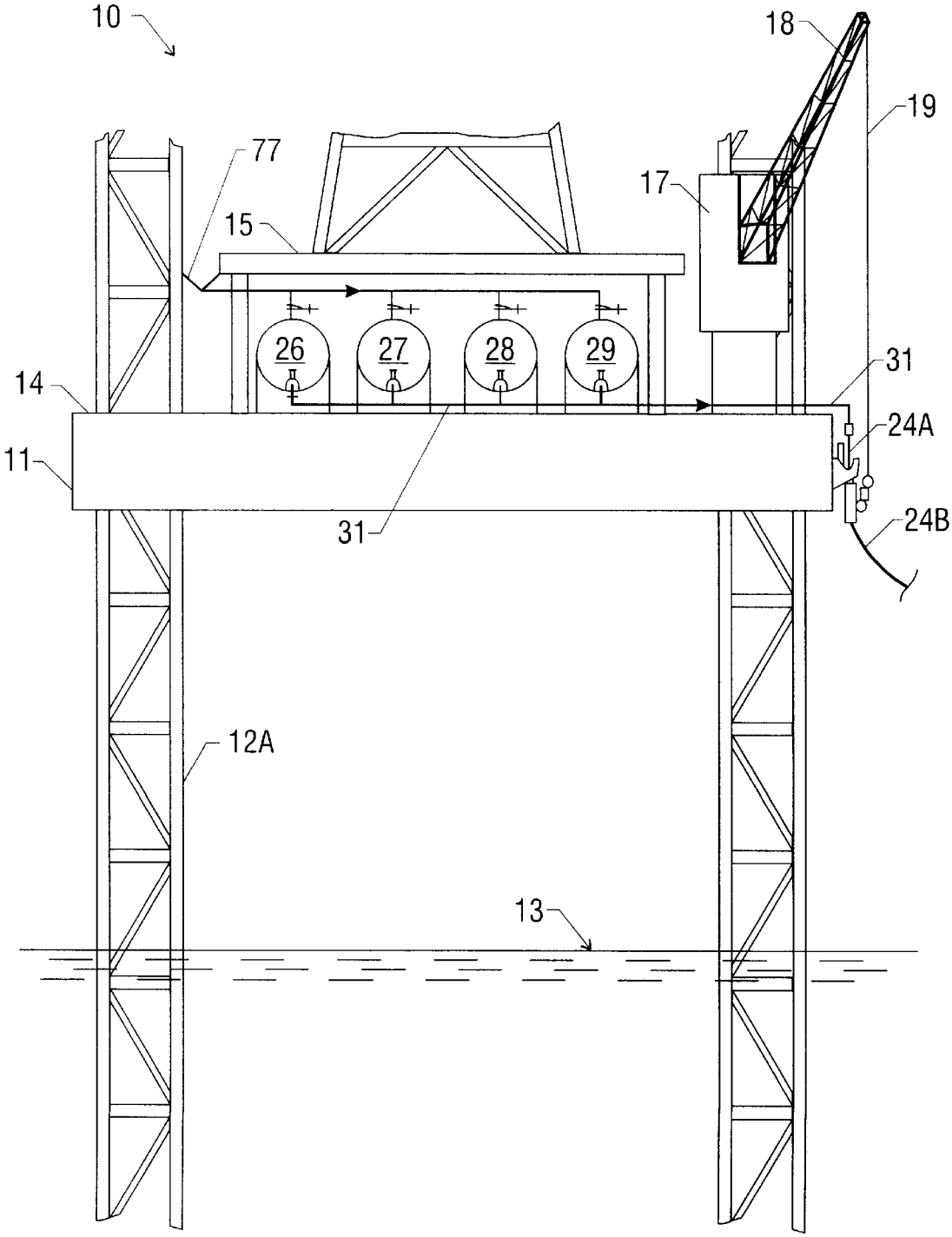
FIGS. 1–1A are elevational views of the preferred embodiment of the apparatus of the present invention.
Figure 1A:
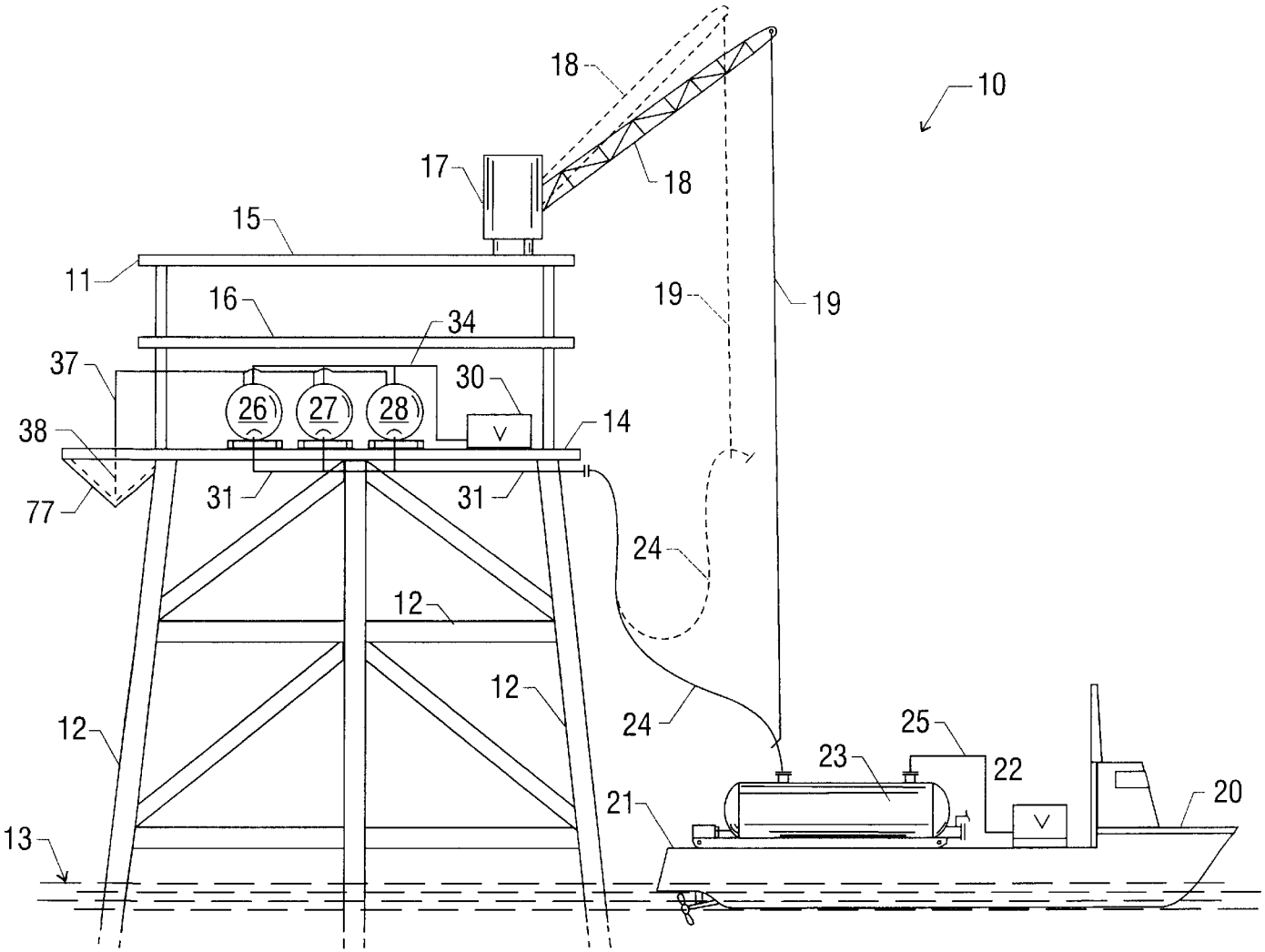
Figure 11:
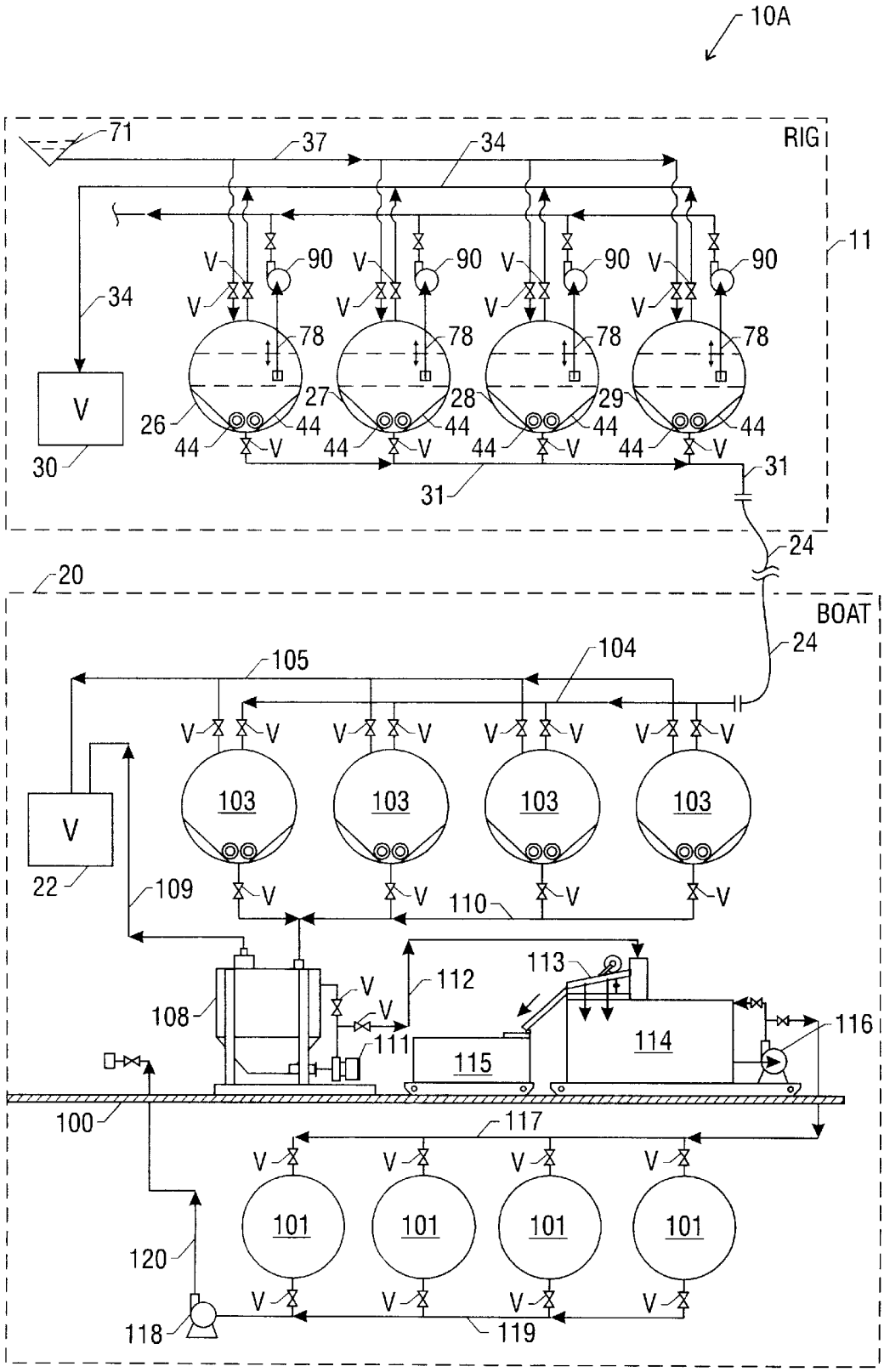
FIG. 11 is a schematic diagram showing the preferred embodiment of the apparatus of he present invention and utilizing the work boat of FIGS. 7 and 8.
Figure 12:
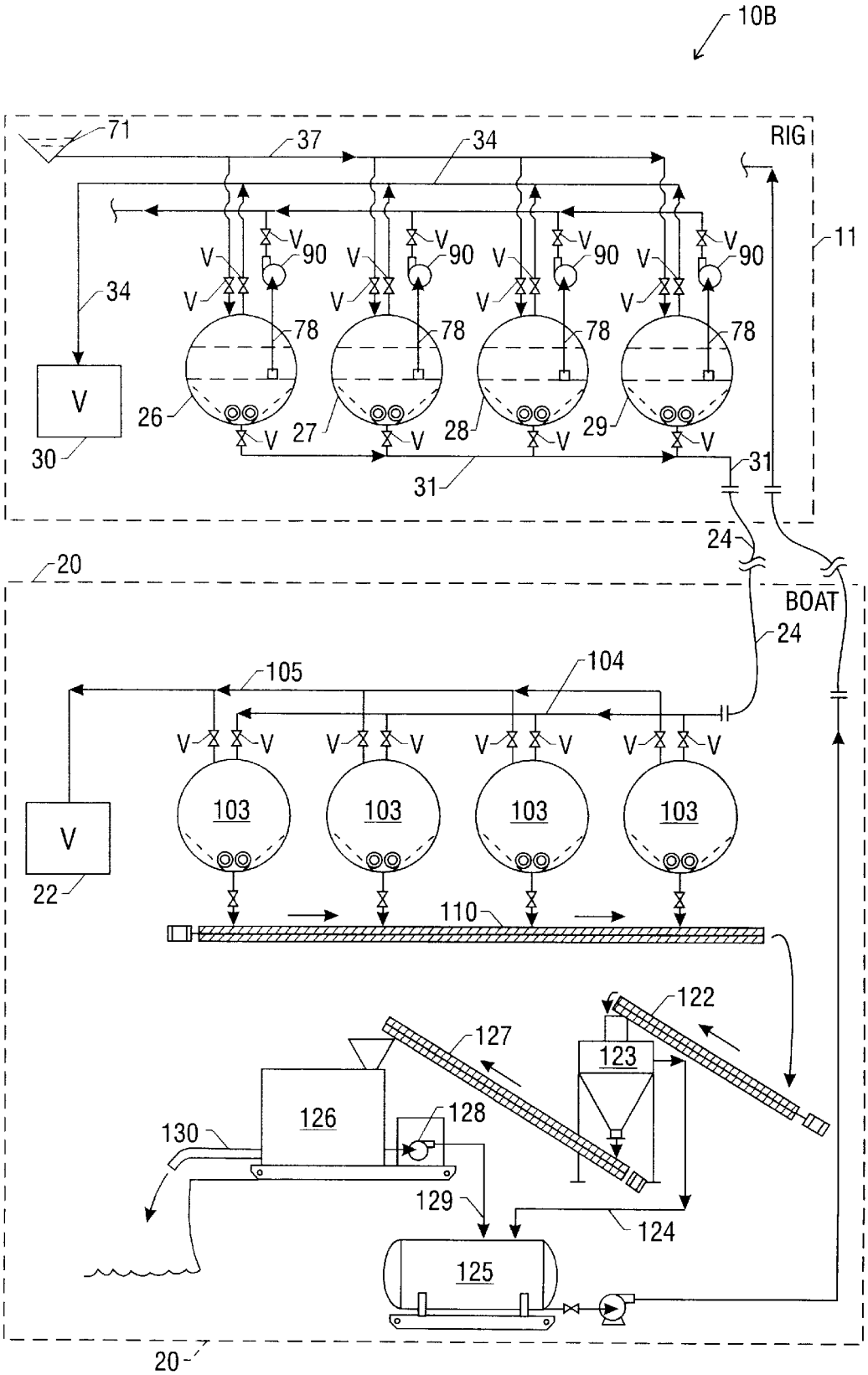
FIG. 12 is a schematic diagram of the preferred embodiment of the apparatus of the present invention and utilizing the work boat of FIGS. 9 and 10.

FIGS. 1–1A and 11–12 show generally the preferred embodiment of the apparatus of the present invention and the method of the present invention, designated generally by the numeral 10 in FIGS. 1, 1A and by the numerals 10A, 10B in FIGS. 11, 12 respectively. In FIG. 1, a jack-up rig type drilling vessel is shown for use with the method and apparatus of the present invention. In FIG. 1A, a fixed drilling platform is shown. Cuttings disposal apparatus 10 is shown in FIGS. 1–1A in an offshore marine environment that includes an offshore oil and gas well drilling platform 11. The platform 11 (FIG. 1A) can include a lower support structure or jacket 12 that extends to the ocean floor and a short distance above the water surface 13. The platform 11 can also be a jack-up rig (FIG. 1) or a semi-submersible. A superstructure is mounted upon the jacket 12 or upon jack-up rig legs 12A, the superstructure including a number of spaced apart decks including lower deck 14, upper deck 15 and in FIG. 1A an intermediate deck 16. Such a platform 11 typically includes a lifting device such as crane 17 having boom 18 and lifting line 19. In general, the concept of an offshore oil and gas well drilling platform is well known in the art.

In FIGS. 1A and 4–10, a work boat 20 is shown moored next to platform 11 for use in practicing the method of the present invention. Work boat 20 has deck 21 that supports vacuum unit 22, vacuum lines 25, and one or more storage tanks 23. In FIGS. 5–10, multiple tanks are provided, designated respectively by the numerals 23A–23E in FIGS. 5–6 and designated respectively of the numerals 101, 103 in FIGS. 7–10.

The drilling platform or drilling rig 11 supports one or more tanks for holding cuttings that have been removed from the well bore during drilling, such as the plurality of rig tanks 26, 27, 28 in FIG. 1A and tanks 26, 27, 28, 29 in FIG. 1.

Figure 15:
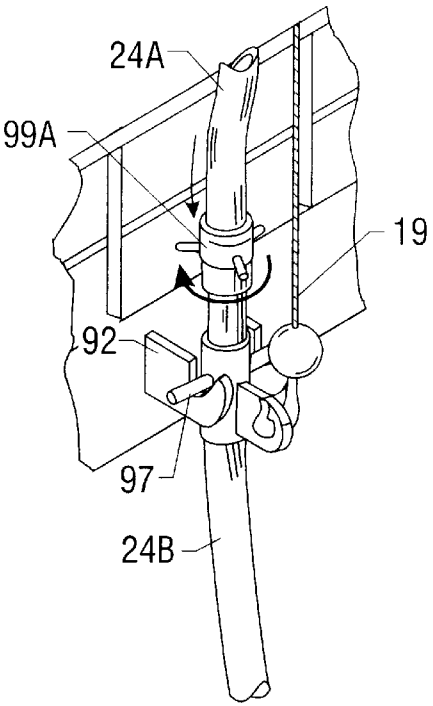
FIGS. 14 and 15 are fragmentary perspective views of the preferred embodiment of the apparatus of the present invention showing the hose used to off load cuttings from rig to boat.
Figure 14:
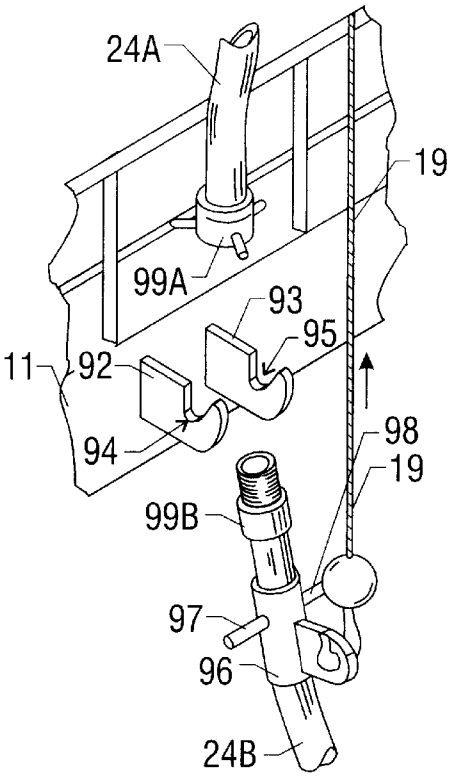
Figure 13:
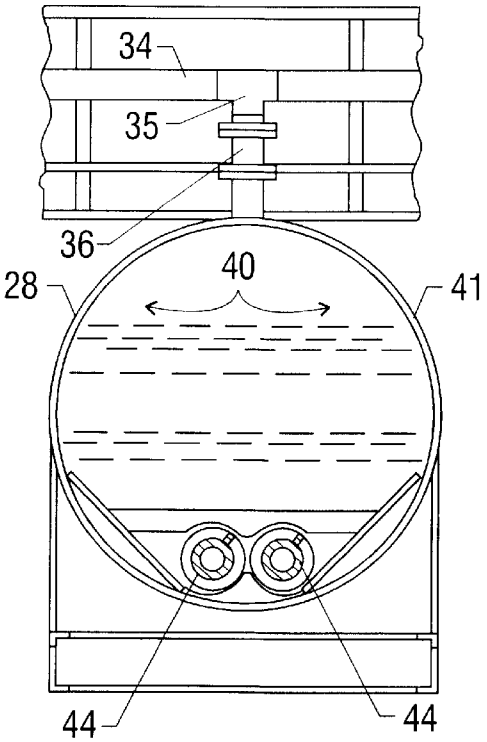
FIG. 13 is a sectional view taken along lines 13—13 of FIG. 5.

The tanks 23 and 23A–23E on boat 20 are preferably very large tanks, each having a volume of between for example between 100 and 1000 barrels. The tanks 26–29 on platform 11 can be, for example, between about 50 and 1000 barrels in volume each. A suction line 24, 24A, 24B can be used to form a removable connection between the plurality of rig vacuum tanks 26, 27, 28, 29 and the boat storage tanks 23 or 23A–23E. The suction line 24 can be attached for example to a discharge manifold 31 (see FIGS. 1, 1A and 2). In another embodiment, (see FIGS. 7–10), the suction line 24 can be used to transmit cuttings from tanks 26, 27, 28, 29 to an underwater storage tank, as will be described more fully hereinafter. In FIGS. 14, 15, a connection arrangement is shown for joining line 24 between platform 11 and boat 20.

During oil and gas well drilling operations, a receptacle on rige 11 such as trough 77 receives drill cuttings that are removed from the well bore and preferably after those drill cuttings have been subjected to solids control, such as the removal of drilling fluids (e.g. drilling mud) therefrom.

Figure 2:
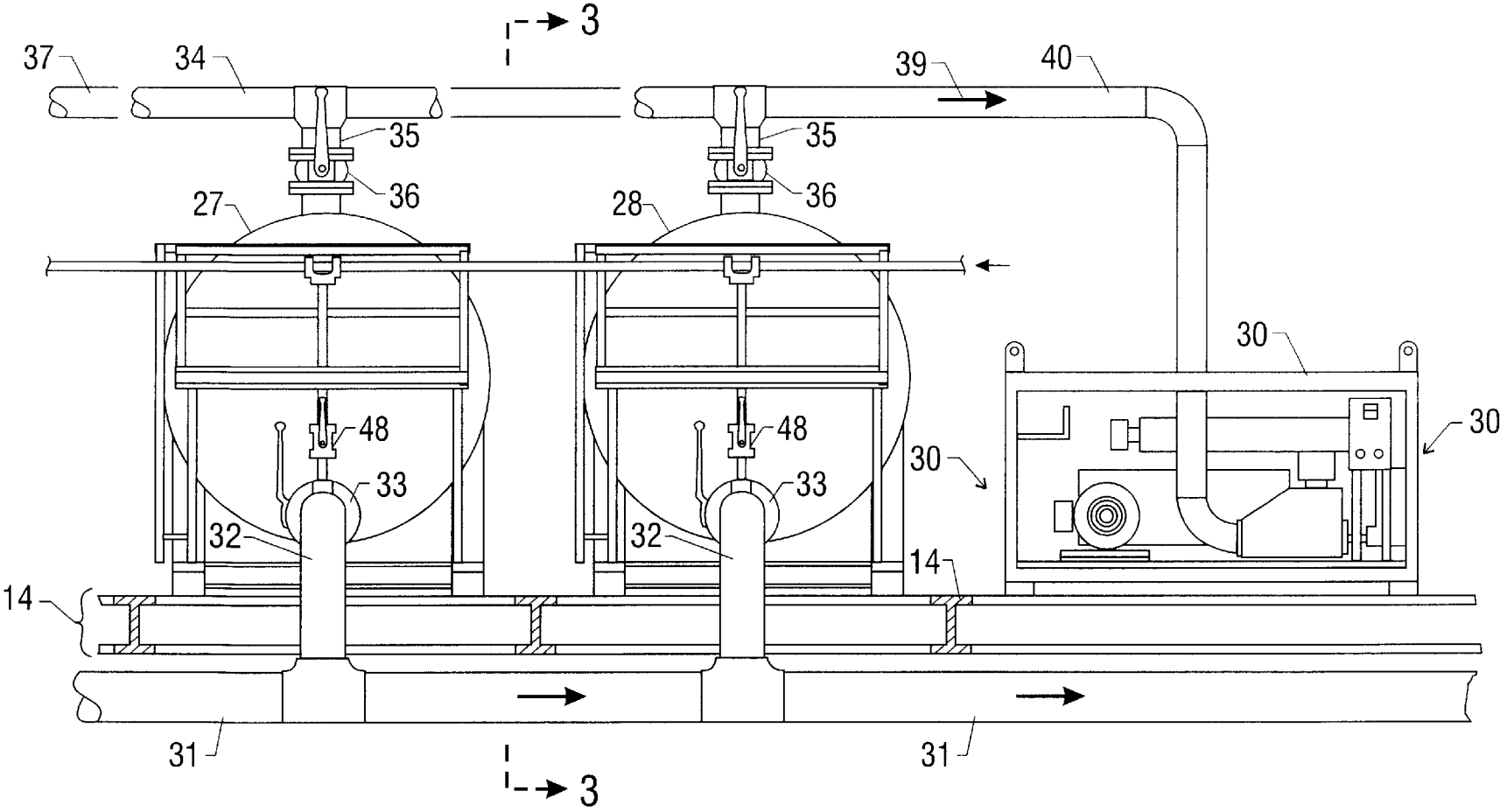
FIG. 2 is a partial elevational view of the preferred embodiment of the apparatus of the present invention.

Cuttings in trough 77 are moved from the trough 77 to one or more of the storage tanks 26, 27, 28, 29 using a vacuum unit 30. Vacuum unit 30 is connected to suction manifold 34 as shown in FIGS. 1A and 2. Arrow 39 in FIG. 2 shows the direction of air flow in the suction manifold 34. The suction manifold 34 communicates between vacuum unit 30 and each of the rig vacuum tanks 26, 27, 28, 29 via a spool piece or suction line 35. The suction line 35 includes valve 36 for valving the flow of air from each tank 26, 27, 28, 29 to vacuum unit 30 via suction manifold 34. An additional suction manifold 37 communicates with each of the tanks 26, 27, 28, 29 and with trough 77 via suction intake 38. In this fashion, valving enables cuttings to be transmitted to any selected tank 26, 27, 28, 29.

Valves 36 control flow of cuttings between each tank 26, 27, 28, 29 and manifold 37. Pressurized air from supply header 45 can be injected into discharge line 32 downstream of valve 33 to assist the flow of cuttings. Valves 48 can be used to valve such air flow. Once vacuum unit 30 is activated, drill cuttings in trough 77 are suctioned from trough 29 using the intake 38 end of header 37. The intake end 38 of suction header 37 can be in the form of a 3"–8" flexible hose, for example. Cuttings can then be transmitted via header 37 to the desired tank 26, 27, 28 or 29.

Figure 3:
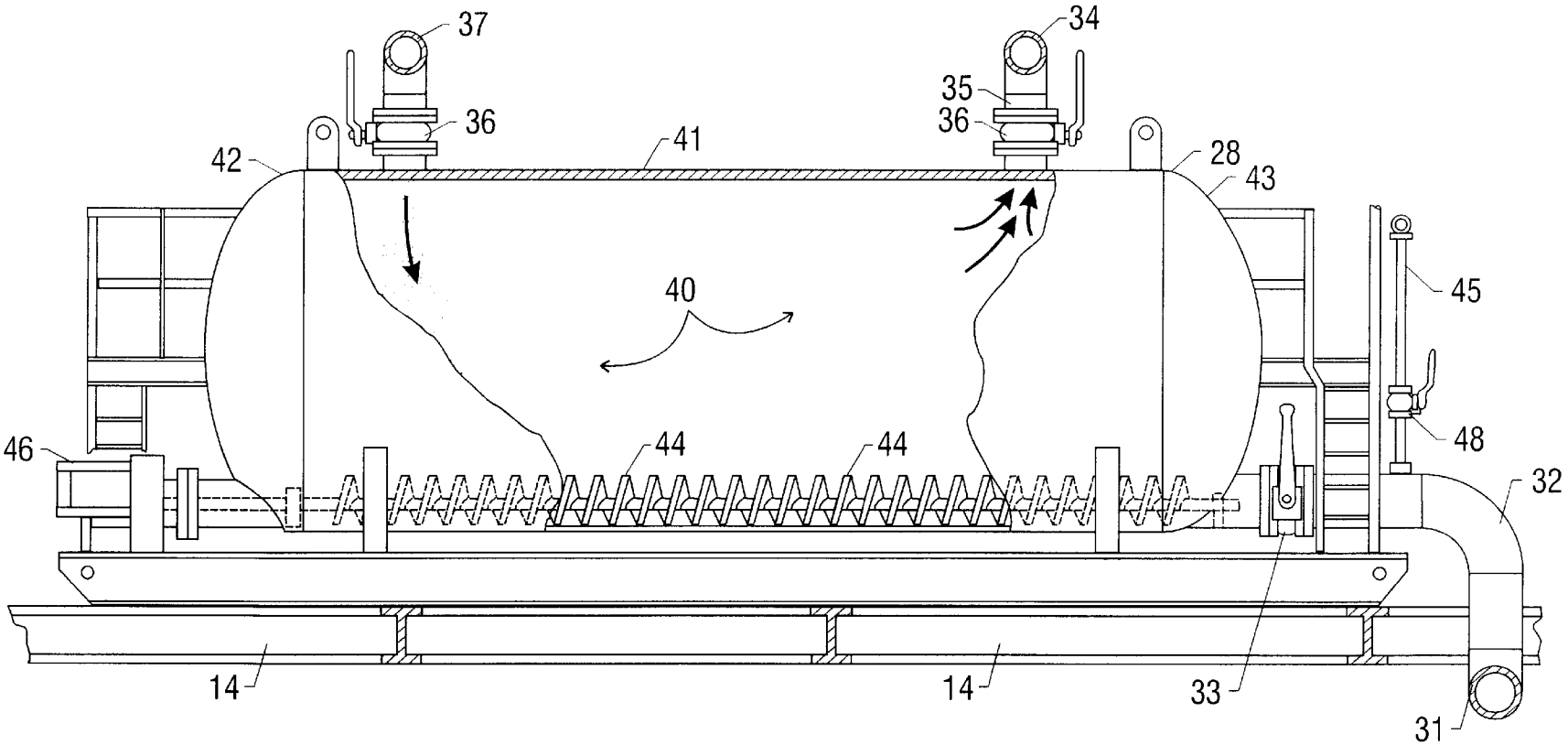
FIG. 3 is a sectional view taken along lines 3—3 of FIG. 2.

FIGS. 2, 3, 3A and 13 show the construction of one of the rig vacuum tanks 26, 27, 28, 29 more particularly. In FIG. 3, 3A, the tank 28 is shown as a pressure vessel capable of holding a vacuum (e.g. sixteen to twenty-five inches of mercury) and having an interior 40 surrounded by cylindrically shaped side wall 41 and two dished end portions 42, 43. At the lower end of tank 28 interior 40, an auger or augers 44 can be used to transfer cuttings that settle in tank 28 to discharge line 32. The well drill cuttings can then enter manifold 31. A valve 33 can be positioned in between each tank 26, 27, 28 and discharge line 32 for valving the flow of cuttings from the tank interior 40 to discharge manifold 31. Auger 44 can be operated by motor drive 46, having a geared transmission as an interface between motor drive 46 and auger 44.

Figure 3A:
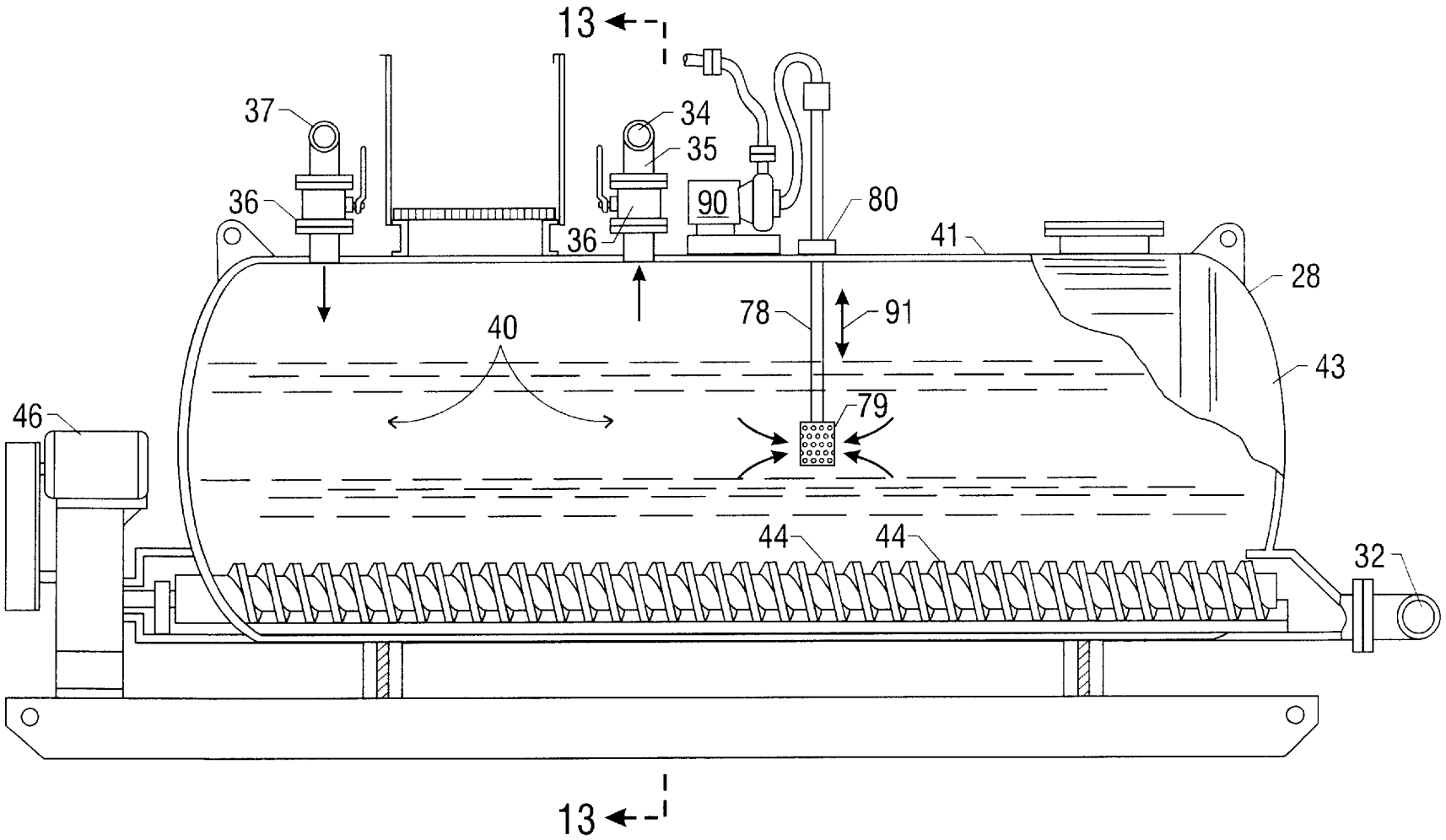
FIG. 3A is a sectional view illustrating an alternate construction for the tank shown in FIGS. 2 and 3.
Figure 4:
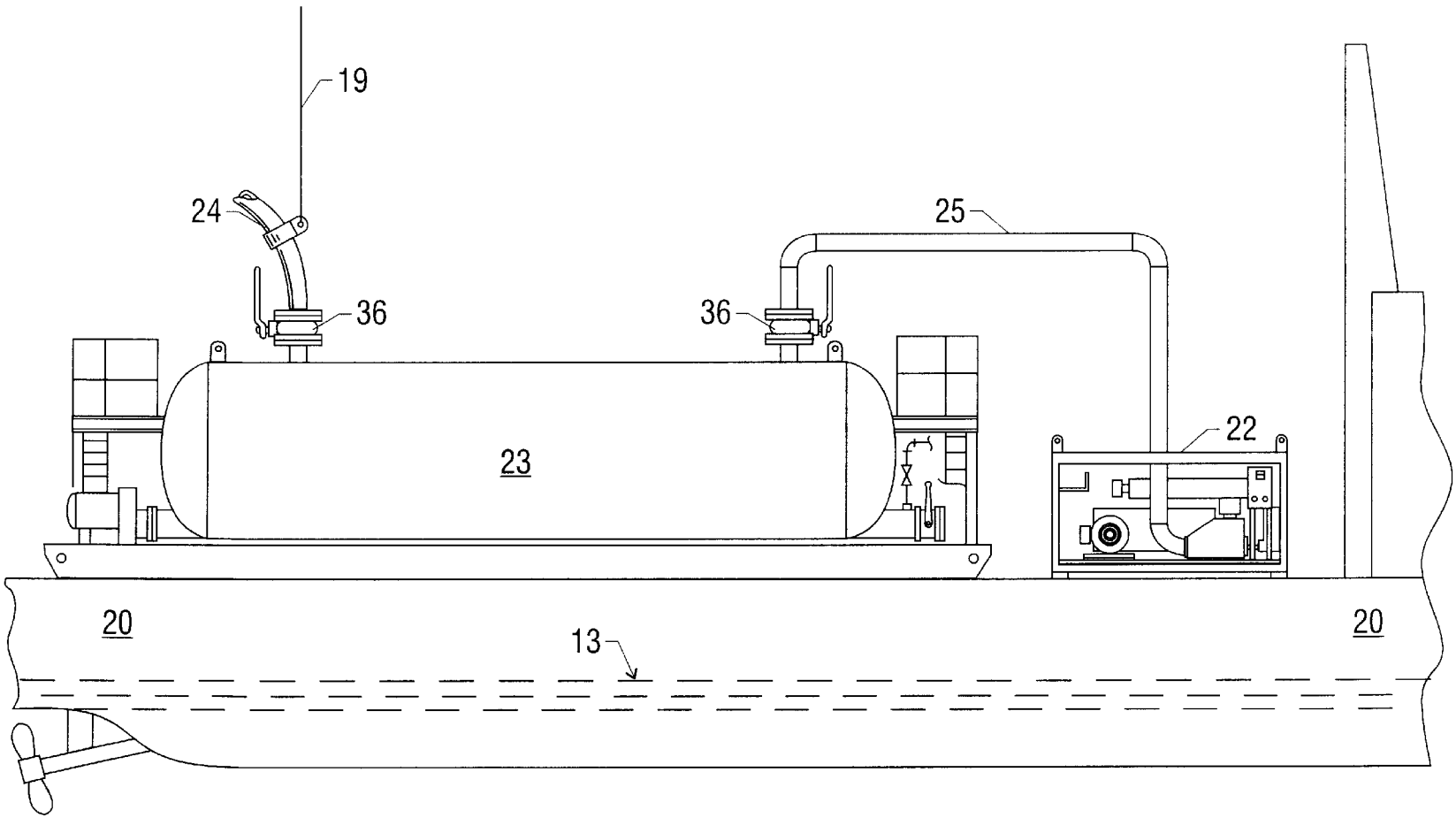
FIG. 4 is a fragmentary elevational view of the preferred embodiment of the apparatus of the present invention illustrating the boat, vacuum unit and tank situated on the deck of the boat.

The tank 28 in FIG. 3A has some features that are optional and additional to the tank 28 of FIG. 3. Tank 28 in FIG. 3A has a cylindrically shaped side wall 41 and dished end portions 42, 43. Augers 44 can be used to transfer cuttings that settle in tank 28 to discharge 32. Drilling fluid to be recycled can be suctioned from interior 40 of tank 28 using suction line 78 that is adjustable up and down as shown by arrow 91 in FIG. 3A. The suction line 78 can be used to recycle drilling fluid after solids within the interior 40 of tank 28 have settled, leaving the drilling fluid as the upper portion of the material contained within interior 40 of tank 28. Suction line 79 fits through sleeve 80 that can be fitted with a set screw, pin, taper lock fitting or similar fitting to grasp suction line 78 at the desired elevational position.

In FIGS. 14 and 15, a connection is shown that can be used to join the hose 24 that transmits cuttings from the rig 11 to the boat 20. In FIGS. 14 and 15, the hose 24 can be in two sections, 24A, 24B that are joined together using fittings 99A–99B. Crane lift line 19 attaches with its lower end portion to fitting 96 using a hook, for example, and an eyelet on the fitting 96 as shown in FIG. 14. The fitting 96 can include a pair of spaced apart transversely extending pins 97, 98 that fit recesses 94, 95 respectively on respective saddle plates 92, 93 that are welded to the rig 11 as shown in FIG. 14. In this fashion, the rig operator can raise the lower portion 24B of hose 24 upwardly until the pins 97, 98 engage the recesses 94, 95 as shown in FIG. 15. With the hose lower end portion 94B so supported by the saddle plates 92, 93, the pins 97, 98 rest in the recesses 94, 95. A rig operator then connects the coupling member 99A to the coupling member 99B as shown in FIGS. 14 and 15. The upper end portion 24A of hose 24 can be connected to header 31 as shown in FIG. 1.

Figure 7:
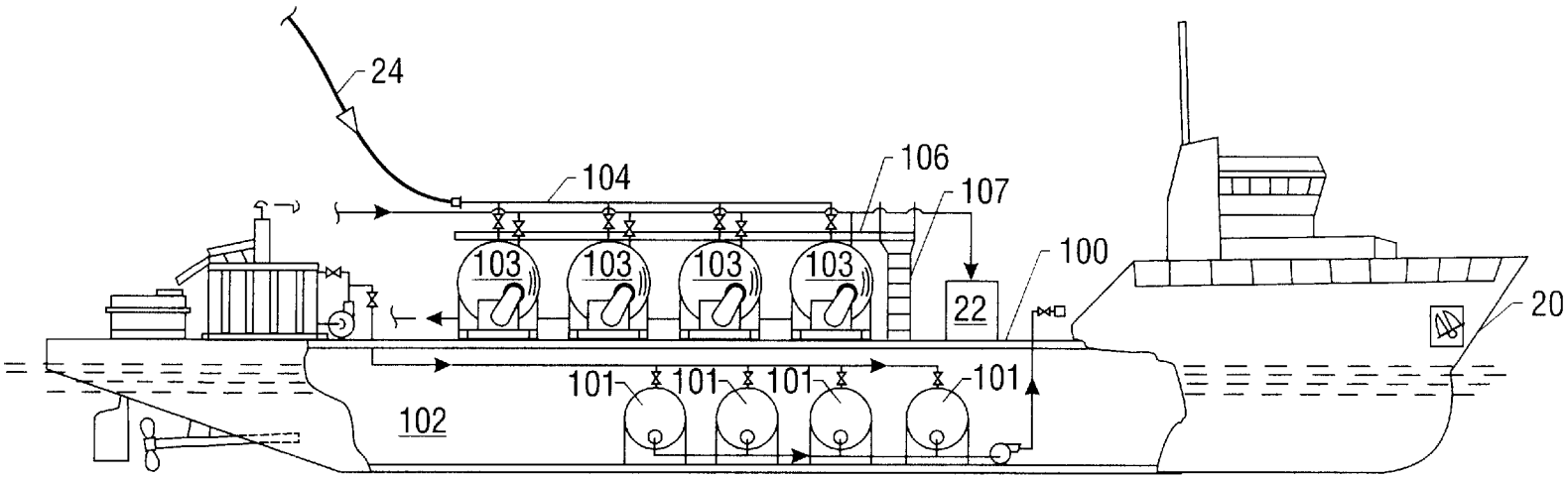
FIG. 7 is an elevational view of the preferred embodiment of the apparatus of the present invention showing an alternate arrangement of storage tanks on the work boat portion thereof.
Figure 8:
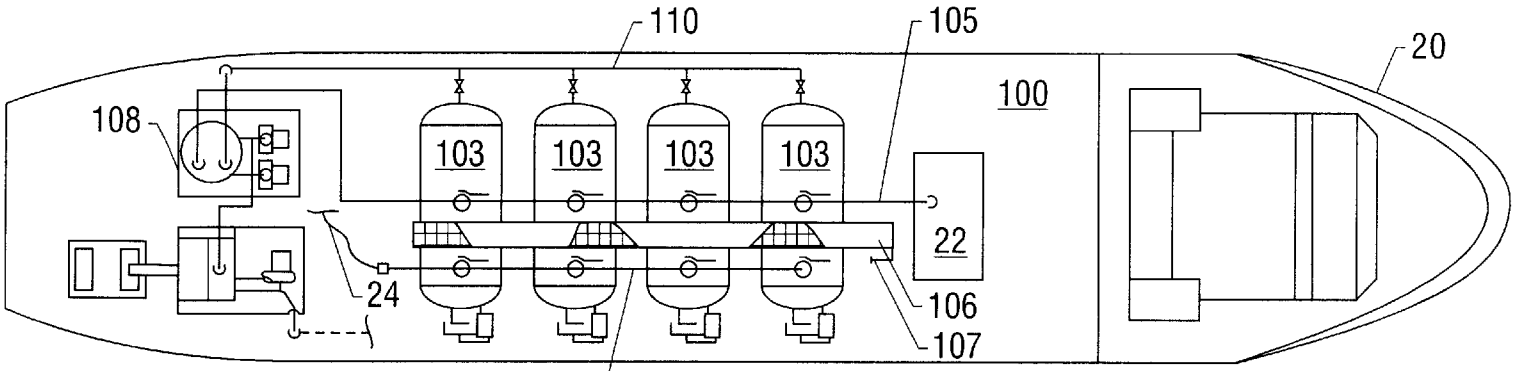
FIG. 8 is a top, plan view of the work boat of FIG. 7.

FIGS. 7–8 and 11 shown an alternate arrangement of the apparatus of the present invention that incorporates optional treatment features on the boat 20. In of FIGS. 7, 8 and 11, the boat 20 is shown outfitted with storage tanks 103 in addition to optional processing equipment that further processes the mixture of cuttings and drilling fluids that are transmitted to the boat 20 via flow line 24.

In FIGS. 7 and 8, the vessel 20 has an upper deck 100 with a plurality of tanks 101 stored under the deck 100 in hold 102, and a second plurality of tanks 103 above deck 100 as shown in FIGS. 7 and 8. Vacuum system 22 on the boat 20 can pull a vacuum on any selected one of the tanks 26–29. Each rig tank 26–29 in FIG. 11 provides a discharge that communicates with discharge header 31. The tanks 26–29 are constructed in accordance with the tank 28 of FIG. 3 or 3A.

In FIGS. 7–8 and 11, the boat 20 is provided with optional equipment to further treat the cuttings that are collected in the plurality of tanks 103 after the cuttings or a mixture of cuttings and drilling fluid has been transferred via flow line 24 to the boat 20.

The cuttings received in the plurality of tanks 103 on the upper deck 100 of vessel 20 are further treated to slurrify the combination of cuttings and drilling fluid in order to obtain a desired particle size and a desired viscosity. This enables this further treated mixture of cuttings and fluid to be pumped into tanks 101 that are under deck 100. In this fashion, storage can be maximized by slurrifying, and storing the cuttings/drilling fluid mixture in the tanks 101 that are under deck 100 in hold 102.

In FIGS. 7, 8 and 11, the flow line 24 transmits cuttings to header 104 that is valved with valves V so that incoming cuttings can be routed to any particular of the tanks 103 as desired. Vacuum unit 22 on boat 20 can pull a vacuum through header 105 on any selected tank 103. This is because each of the tanks 103 is valved with valves V between the tank 103 and header 105. A walkway 106 accessible by ladder 107 enables an operator to move between the various valves V and headers 104, 105 when it is desired to open a valve V or close a valve V that communicates fluid between a header 104 or 105 and a tank 103.

By closing all of the valves V that are positioned in between a tank 103 and the vacuum header 105, the vacuum can be used to pull a vacuum on cuttings grinder unit 108 via flow line 109 (see FIG. 11). A discharge header 110 is used to communicate discharged fluid that leaves a tank 103 to cuttings grinder unit 108. Valves V are used to control the flow of fluid between each tank 103 and header 110 as shown in FIG. 11. Pump 111 enables material to be transferred from cuttings grinder unit 108 via flow line 112 to shaker 113 and holding tank 114. Material that is too large to be properly slurried is removed by shaker 113 and deposited in cuttings collection box 115 for later disposal. Material that passes through shaker 113 into holding tank 114 is slurried by recirculation from tank 114 to pump 116 and back to tank 114. When a desired particle size and viscosity are obtained, the slurry is pumped with pump 116 to one of the tanks 101. Each of the tanks 101 is valved between discharge header 119 and tanks 101 as shown in FIG. 11.

When the boat 20 reaches a desired disposal facility, pump 118 receives fluid from discharge header 119 for transmission via line 120 to a desired disposal site such as a barge, on land disposal facility or the like.

Figure 9:
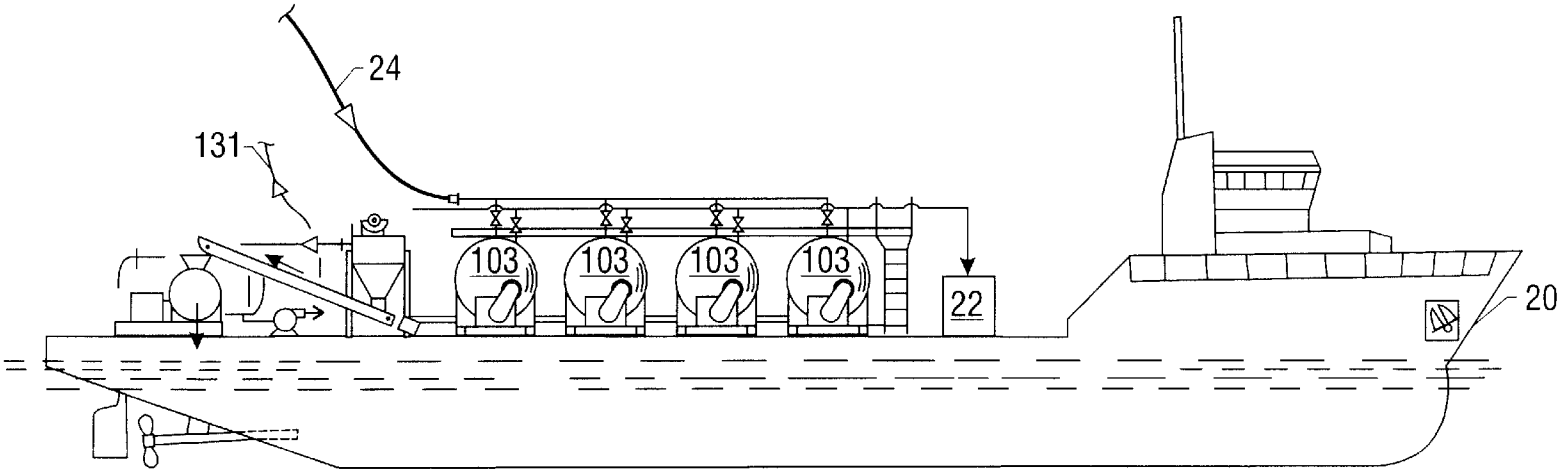
FIG. 9 is an elevational view of the preferred embodiment of the apparatus of the present invention showing another alternate arrangement of storage tanks on the work boat portion thereof.
Figure 10:
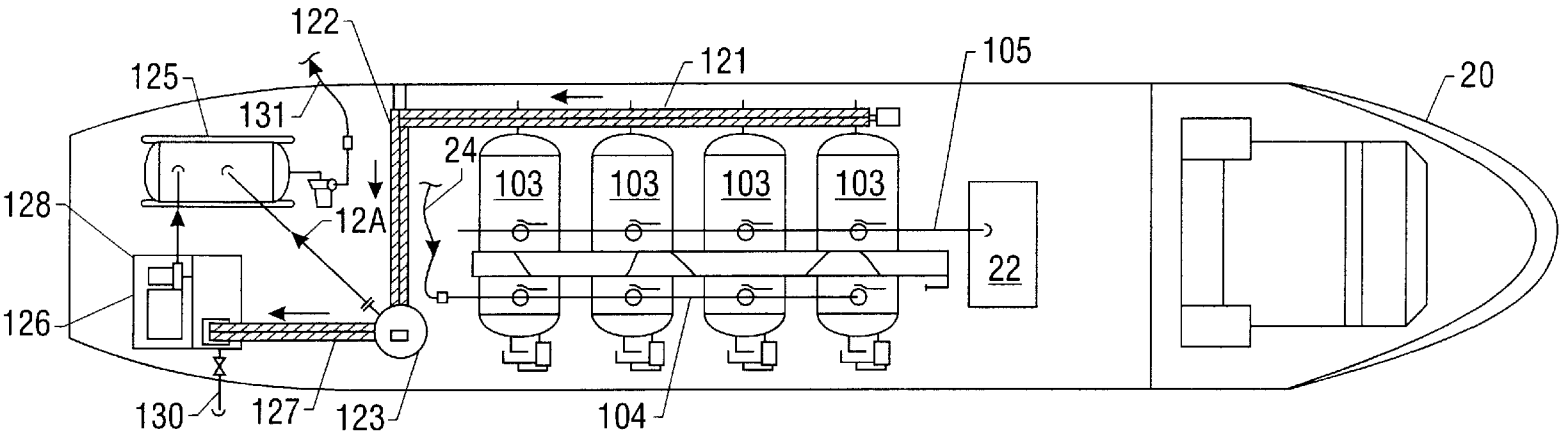
FIG. 10 is a top, plan view of the work boat of FIG. 9.

In FIGS. 9–10 and 12, the apparatus of the present invention is shown fitted with optional treatment features, designated generally by the numeral 10B in FIG. 12. In the embodiment of FIGS. 9, 10 and 12, processing is used to remove desirable drilling fluid from cuttings that are transferred to boat 20 via line 24. In FIGS. 9, 10 and 12, the rig 11 has a plurality of tanks 26–29, and inlet header 37, a vacuum system 30, a vacuum header 34, and pumps 90 to remove desirable drilling fluid at the rig or platform 11 for recycling. However, in FIGS. 9–10 and 12, recycling of drilling fluid also occurs on boat 20. Thus, the equipment located on rig 11 is the same in the embodiment of FIGS. 11 and 12. The equipment on boat 20 differs in the embodiment of FIGS. 9–10 and 12. The boat 20 in FIGS. 9–10 and 12 includes a plurality of tanks 103 that discharge cuttings to a first conveyor such as auger 121. Auger 121 directs cuttings that are discharged by tanks 103 to a conveyor such as screw conveyor 122. Screw conveyor 122 deposits cuttings in separator 123. In separator 123, some drilling fluids are removed and transmitted via flow line 124 to recycled liquid holding tank 125. The separator 123 is preferably a hopper with a vibrating centrifuge, spinning basket driven by a motor. Such separators 123 are commercially available.

After drilling fluid has been separated at separator 123, dry cuttings are transmitted to cuttings dryer unit 126 using screw conveyor 127. The cuttings dryer unit 126 further dries the cuttings so that they can be transferred to a vessel, barge, etc. or dumped overboard via discharge pipe 130. Any fluid that is removed from the cuttings at cuttings dryer unit 126 can be recycled through pump 128 and flow line 129 to liquid holding tank 125 and then to the platform 11 via flow line 131.

Figure 5:
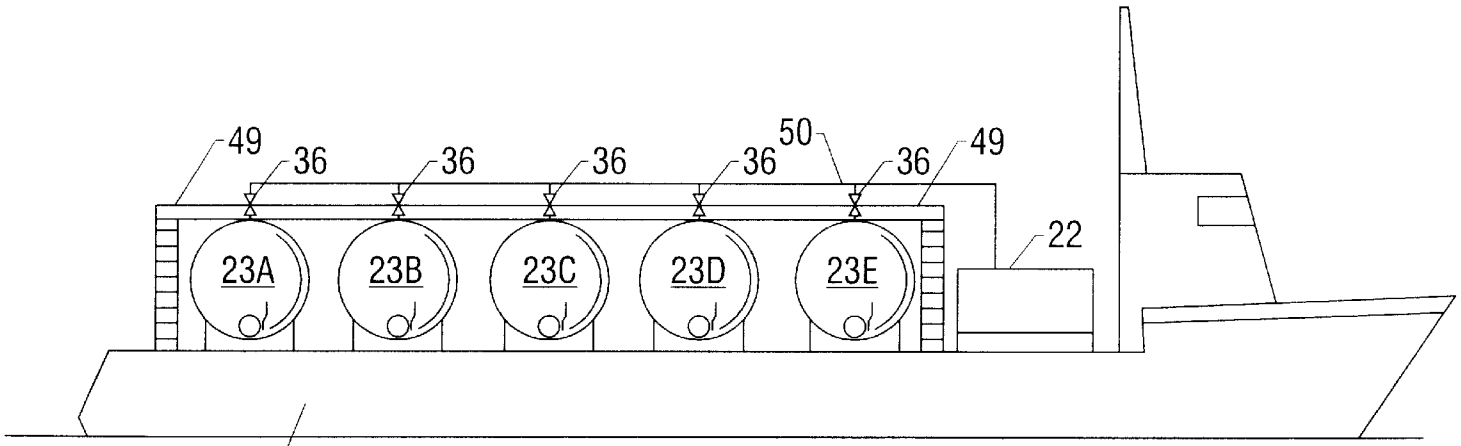
FIG. 5 is an elevational view of the preferred embodiment of the apparatus of the present invention showing an alternate arrangement of storage tanks on the work boat portion thereof.
Figure 6:
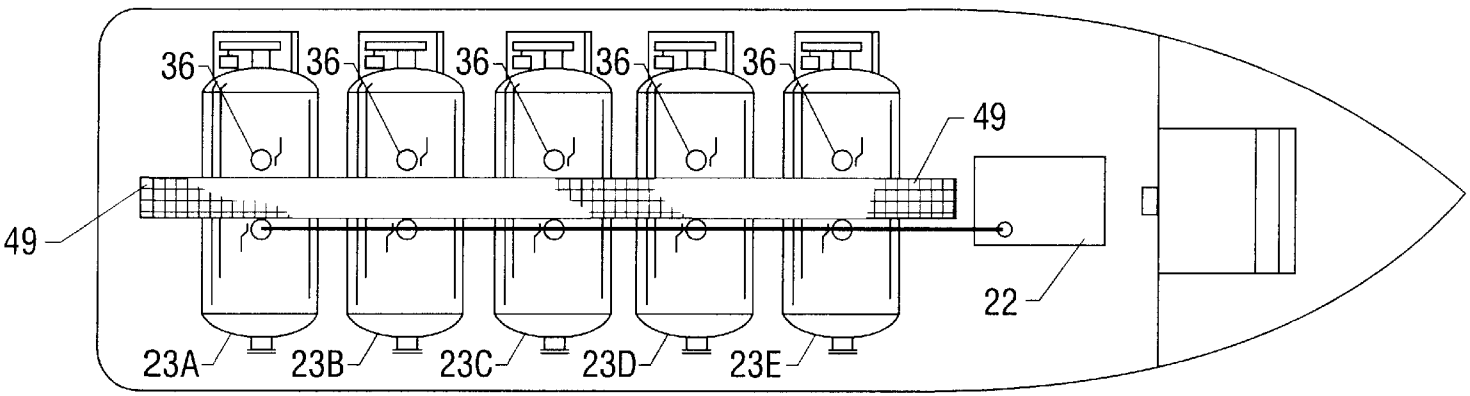
FIG. 6 is a plan view of the preferred embodiment of the apparatus of the present invention showing the work boat configuration of FIG. 5.

FIGS. 16–19 show an underwater tank assembly 51 that can be used to replace or supplement the tank 23 of FIG. 1 or the plurality of tanks 23A–23E in FIGS. 5 and 6. In FIGS. 16–19, underwater tank assembly 51 can be stored on the sea bed 76 so that it does not occupy rig space or space on the deck 21 of vessel 20. Rather, the underwater tank assembly 51 can receive cuttings that are discharged from tanks 26, 27, 28 on rig 11 by discharging the cuttings from the selected tank 26, 27, 28 via header 31 and into cuttings flowline 60. The cuttings flowline 60 can be attached to header 31 in a similar fashion to the attachment of flowline 24 shown in FIG. 1.

The flowline 21 transmits cuttings from header 31 to tank 23 on boat 20 or to a plurality of tanks 23A–23E on boat 20. The cuttings flow line 60 would be of sufficient length to extend from the discharge flowline 31 to the sea bed 76 and specifically to inlet fitting 59 on main tank 52 of underwater tank assembly 51, as shown in FIG. 7. In this fashion, cuttings can be discharged from the rig 11 tanks 26, 27, 28 to underwater tank assembly 51 in the direction of arrow 61. As with the embodiment of FIGS. 1–6, a vacuum unit such as vacuum unit 22 on vessel 20 or a vacuum unit such as vacuum unit 30 on rig 11 can be used to pull a vacuum on main tank 52.

Figure 16:
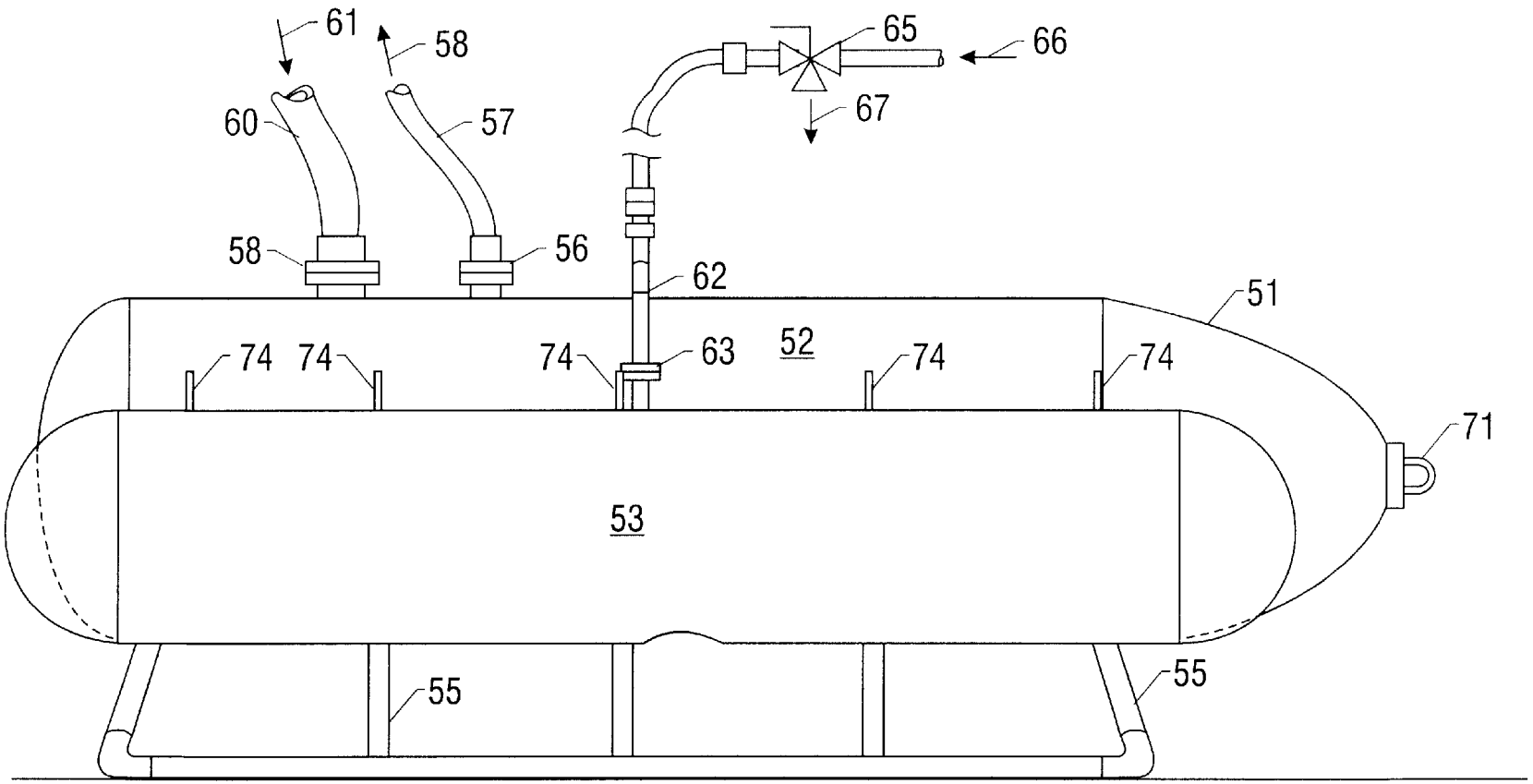
FIG. 16 is an elevational view of an underwater storage tank for use with the method of the present invention and showing an alternate apparatus of the present invention.
Figure 17:
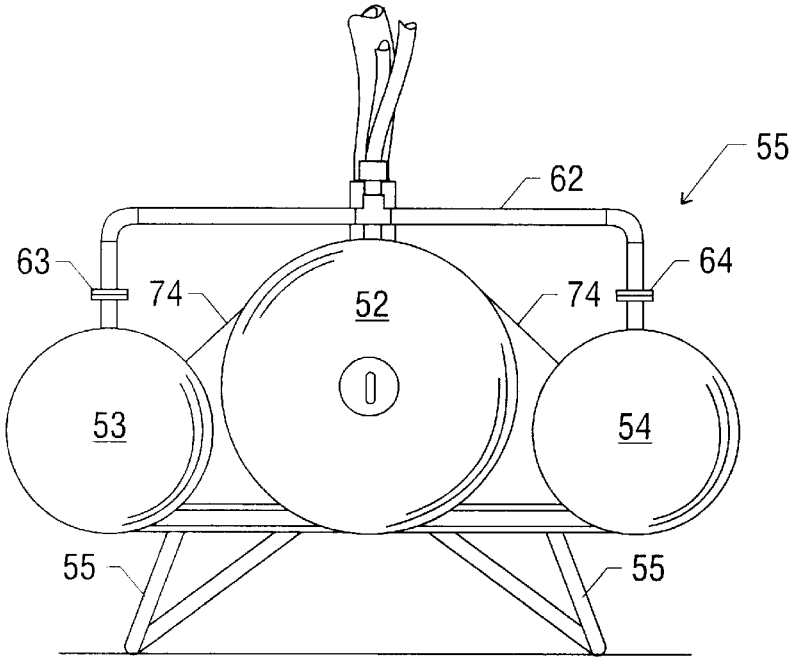
FIG. 17 is an end view of the underwater storage tank of FIG. 7.
Figure 18:
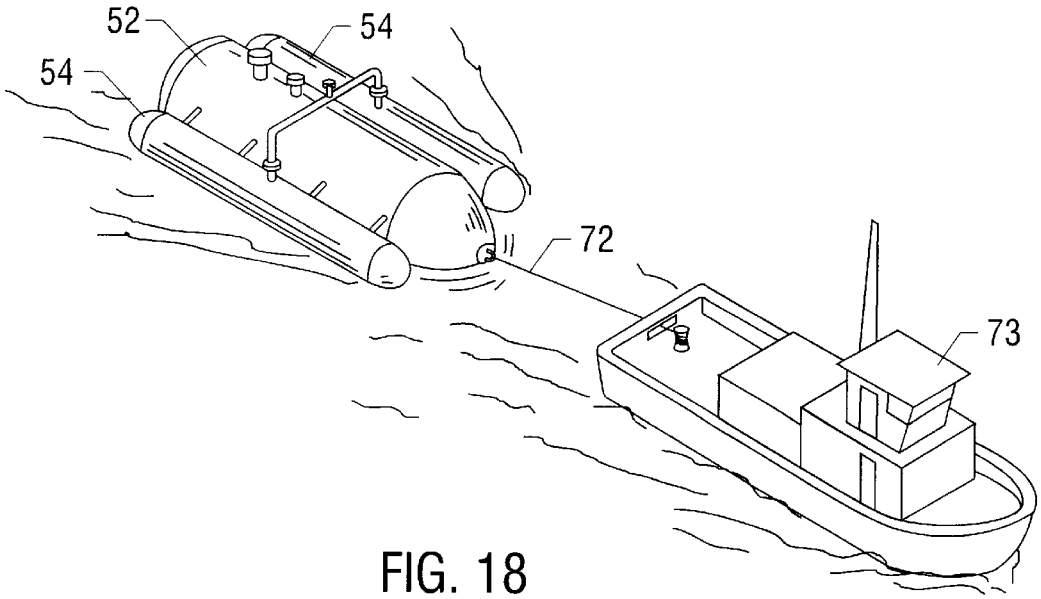
FIG. 18 is a perspective view of the storage tank of FIGS. 7 and 8 while in tow.

In FIG. 16, main tank 52 provides a vacuum fitting 56 to which vacuum line 57 is attached. A vacuum unit 22 or 30 can pull a vacuum on tank 52 with air flowing in the direction of arrow 58. This flow enhances the flow of cuttings from the tanks 26, 27, 28 on rig 11 into main tank 52 in the direction arrow 61.

The main tank 52 has ballasting in the form of a plurality of ballast tanks 53, 54. The combination of tanks 52, 53, 54 are connected by a welded construction for example using a plurality of connecting plates 74.

Figure 19:
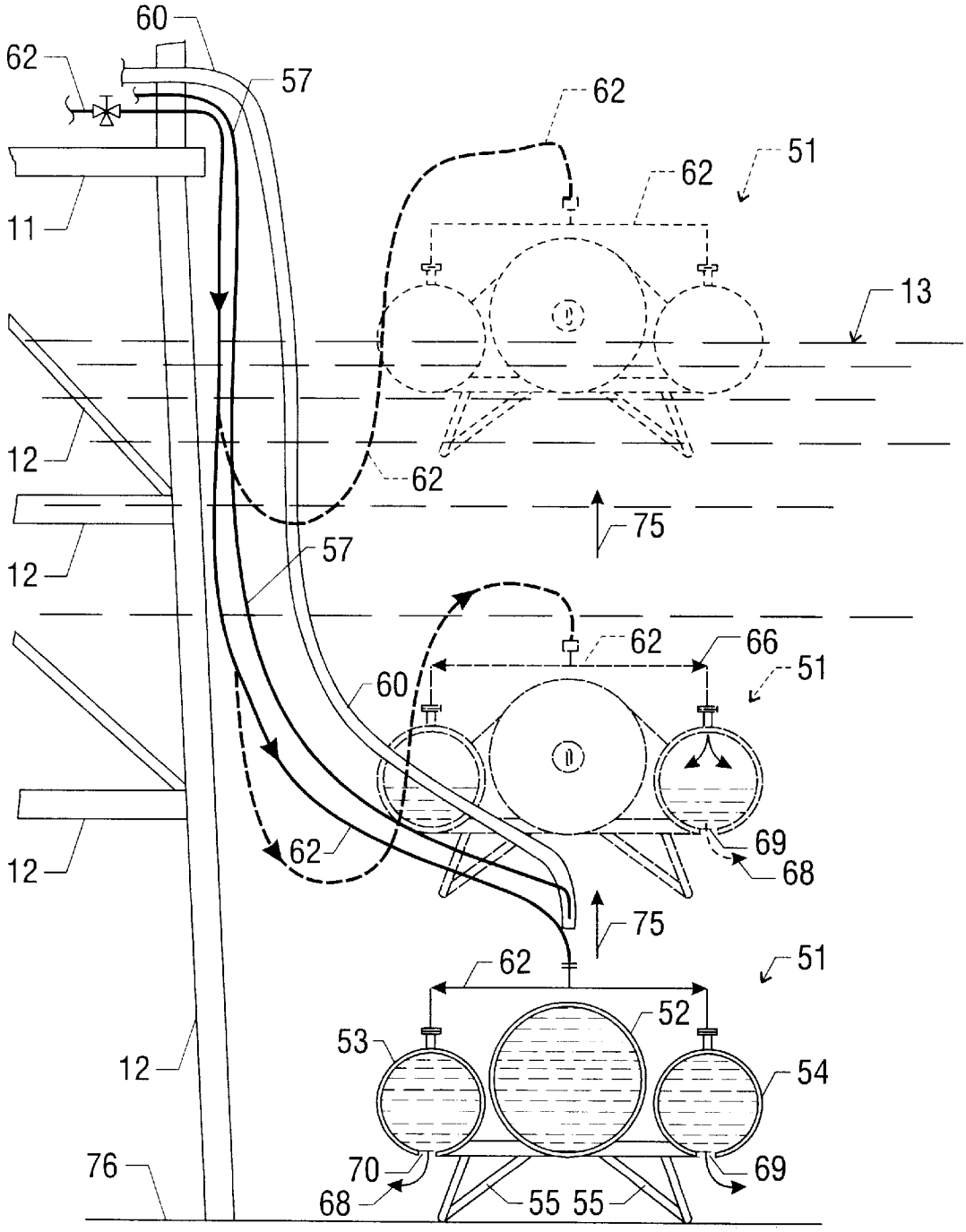
FIG. 19 is a schematic view of the alternate embodiment of the apparatus of the present invention and showing the alternate method of the present invention using an underwater storage tank.

Ballast piping 62 communicates with fittings 63, 64 that are positioned respectively on the ballast tanks 53, 54 as shown on FIG. 8. Control valve 65 can be used to transmit pressurized air in the direction of arrow 66 into the ballast tanks 53, 54 such as when the underwater tank assembly 51 is to be raised to the surface, as shown in FIG. 19, the upward movement indicated by arrows 75.

Arrow 67 in FIG. 16 indicates the discharge of air from ballast tanks 53, 54 using control valve 65 when the underwater tank assembly 51 is to be lowered to the sea bed 76. In FIG. 19, arrows 68 indicate the discharge of water from tanks 53, 54 when the underwater tank assembly is to be elevated. Outlet fittings 69, 70 enable water to be discharged from ballast tanks 53, 54.

Support frame 55 can be in the form of a truss or a plurality of feet for engaging the sea bed 76 when the underwater tank assembly 51 is lowered to the sea bed prior to be being filled with drill cuttings during use.

When main tank 52 has been filled with well drill cuttings and the tank assembly 51 has been raised to the water surface 13, the tank assembly 51 can be towed to a disposal sight using tow line 72, tug boat 73 and tow eyelet 71 on tank 52.

It should be understood that the underwater tank assembly 51 can be used to supplement tanks 23, 23A–23E as described in the preferred embodiment of FIGS. 1–6. Alternatively, the underwater tank assembly 51 can be used for storage instead of the boat mounted tanks 23, 23A–23E.

The following table lists the parts numbers and parts descriptions used herein and in the drawings attached hereto.

PARTS LIST

| Part Number | Description |
|---|---|
| 10 | cuttings disposal apparatus |
| 11 | platform |
| 12 | jacket |
| 13 | water surface |
| 14 | lower deck |
| 15 | upper deck |
| 16 | intermediate deck |
| 17 | crane |
| 18 | boom |
| 19 | lifting line |
| 20 | work boat |
| 21 | aft deck |
| 22 | vacuum unit |
| 23 | storage tank |
| 23A | storage tank |
| 23B | storage tank |
| 23C | storage tank |
| 23D | storage tank |
| 23E | storage tank |
| 24 | first suction line |
| 25 | second suction line |
| 26 | rig vacuum tank |
| 27 | rig vacuum tank |
| 28 | rig vacuum tank |
| 29 | rig vacuum tank |
| 30 | vacuum unit |
| 31 | discharge manifold |
| 32 | discharge line |
| 33 | outlet valve |
| 34 | suction manifold |
| 35 | suction line |
| 36 | valve |
| 37 | manifold |
| 38 | suction intake |
| 39 | arrow |

-continued

PARTS LIST

| Part Number | Description |
|---|---|
| 40 | interior |
| 41 | wall |
| 42 | end |
| 43 | end |
| 44 | auger |
| 45 | supply header |
| 46 | motor drive |
| 47 | valve |
| 48 | valve |
| 49 | walkway |
| 50 | header |
| 51 | underwater tank assembly |
| 52 | main tank |
| 53 | ballast tank |
| 54 | ballast tank |
| 55 | support frame |
| 56 | vacuum fitting |
| 57 | vacuum line |
| 58 | arrow |
| 59 | inlet fitting |
| 60 | cuttings flow line |
| 61 | arrow |
| 62 | ballast piping |
| 63 | ballast fitting |
| 64 | ballast fitting |
| 65 | control valve |
| 66 | arrow |
| 67 | arrow |
| 68 | arrow |
| 69 | outlet |
| 70 | outlet |
| 71 | towing eyelet |
| 72 | towline |
| 73 | tugboat |
| 74 | connecting plate |
| 75 | arrow |
| 76 | seabed |
| 77 | trough |
| 78 | suction line |
| 79 | screen |
| 80 | sleeve |
| 90 | pump |
| 91 | arrow |
| 92 | plate |
| 93 | plate |
| 94 | recess |
| 95 | recess |
| 96 | fitting |
| 97 | pin |
| 98 | pin |
| 99A | coupling member |
| 99B | coupling member |
| 100 | deck |
| 101 | tank |
| 102 | hold |
| 103 | tank |
| 104 | header |
| 105 | header |
| 106 | walkway |
| 107 | ladder |
| 103 | cuttings grinder unit |
| 109 | flowline |
| 110 | header |
| 111 | pump |
| 112 | flowline |
| 113 | shaker |
| 114 | holding tank |
| 115 | collection box |
| 116 | pump |
| 117 | header |
| 118 | pump |
| 119 | header |
| 120 | flow line |
| 121 | auger |
| 122 | screw conveyor |

-continued

PARTS LIST

| Part Number | Description |
|---|---|
| 123 | separator |
| 124 | flow line |
| 125 | tank |
| 126 | cuttings dryer unit |
| 127 | conveyor |
| 128 | pump |
| 129 | flow line |
| 130 | discharge pipe |
| 131 | flow line |
| V | valve |

The foregoing embodiments are presented by way of example only; the scope of the present invention is to be limited only by the following claims.

What is claimed is:

1. A method for disposing of drill cuttings from an oil and/or gas well drilling platform, comprising:

a) separating said drill cuttings from substantially all of a well drilling fluid in which said drill cuttings have been conveyed from an area being drilled;

b) transporting said drill cuttings to a materials trough;

c) transporting said drill cuttings from said trough via a suction line to a holding tank using a vacuum; and d) transferring the drill cuttings from the holding tank to a work boat via a flowline.

2. A method as claimed in claim 1, wherein said drill cuttings are transported directly to said holding tank via a first suction line.

3. A method as claimed in claim 2, wherein a vacuum is generated within the holding tank so that said drill cuttings are transported from said trough to said holding tank via said first suction line.

4. A method as claimed in claim 1, wherein said vacuum is generated by vacuum-generating means that is in fluid communication with the holding tank via a second suction line.

5. A method as claimed in claim 1, wherein said holding tank has a screw conveyor therein.

6. A method as claimed in claim 5, wherein a vacuum is generated within said holding tank so that said drill cuttings are transported from said trough to said holding tank via said first suction line and cuttings are emptied from said holding tank using said screw conveyor.

7. A method as claimed in claim 6, wherein said vacuum is generated by a vacuum-generating means that is in fluid communication with a boat tank on the work boat via a second suction line.

8. A method as claimed in claim 7, wherein liquid waste and solid waste are removed from said second suction line before entering said boat tank.

9. A method as claimed in claim 8, wherein liquid waste and solid waste are removed from the second suction line at a separator that is positioned in fluid communication with the second suction line upstream of the vacuum-generating means.

10. A method as claimed in claim 7, wherein the vacuum-generating means generates a fluid flow in the first and second suction lines in the range of about 8.5 to 42.5 $m^3$ (300 to 1500 cubic feet) per minute.

11. A method as claimed in claim 1, wherein the vacuum generated is in the range of about 54200 to 84700 $Nm^{-2}$ (16 to 25 inches of mercury).

12. A method as claimed in claim 1, wherein said drill cuttings are transported to said work boat in part through gravity flow.

13. A method as claimed in claim 1, wherein said drill cuttings are transported via said first suction line from the bottom of said trough.

14. A method as claimed in claim 1, wherein the flow velocity in the first suction line is in the range of about 30.5 to 91.5 meters (100 to 300 feet) per second.

15. A method as claimed in claim 1, wherein said drilling fluid is recycled for further use.

16. Apparatus for use in disposing of drill cuttings from an oil and/or gas well drilling platform, comprising:

a) means for separating said drill cuttings from substantially all of a well drilling fluid in which said drill cuttings are carried from the area being drilled;

b) a materials trough to which said drill cuttings are transported;

c) a holding tank on the platform for holding said drill cuttings;

d) a work boat floating next to the platform;

e) a suction line for transporting said drill cuttings from said trough to said holding tank; and f) a flowline for transferring cuttings from the holding tank to the work boat.

17. Apparatus as claimed in claim 16, further comprising vacuum-generating means for generating a vacuum within the holding tank so that said drill cuttings are transported from said trough to said tank via said suction line.

18. Apparatus as claimed in claim 17, wherein said vacuum-generating means is in fluid communication with the holding tank via a second suction line.

19. Apparatus as claimed in claim 16, wherein the holding tank includes a screw conveyor therein, said first suction line transporting said drill cuttings to said holding tank and said screw conveyor discharging said drill cuttings from said holding tank.

20. Apparatus as claimed in claim 19, further comprising vacuum-generating means for generating a vacuum within the holding tank so that said drill cuttings are transported from said trough to said holding tank via said first suction line.

21. Apparatus as claimed in claim 20, wherein said vacuum-generating means is in fluid communication with the holding tank via a second suction line.

22. Apparatus as claimed in claim 18 or claim 21, further comprising a separator that is positioned in fluid communication with the second suction line upstream of the vacuum-generating means for removing liquids and solids from the second suction line.

23. A method for removing drill cuttings from an oil and gas well drilling platform that uses a drill bit supported with a drill string and a well drilling fluid during a digging of a well bore, comprising the steps of:

a) separating drill cuttings from the well drilling fluid on the drilling platform so that the drilling fluid can be recycled into the well bore during drilling operations;

b) transmitting the cuttings to a cuttings receptacle on the platform;

c) suctioning the separated drill cuttings with a first suction line having an intake end portion that is positioned at the receptacle;

d) transmitting the drill cuttings via the first suction line to a holding tank that has at least one access opening for communicating with the tank interior;

e) forming a vacuum within the holding tank interior with a blower that is in fluid communication with the tank interior via a second vacuum line; and f) transferring the cuttings from the holding tank to a work boat using a flowline.

24. The method of claim 23 wherein there are a plurality of holding tanks on the platform.

25. The method of claim 24 further comprising the step of connecting the holding tanks with a suction manifold.

26. The method of claim 25 further comprising the step of valving the suction manifold to selectively pull a vacuum on a selected tank or tanks.

27. The method of claim 23 wherein the flow velocity in the suction line is about 30.5 to 91.5 meters (one hundred to three hundred feet) per second.

28. The method of claim 23 wherein liquids and solids are separated from the suction line at the holding tank.

29. The method of claim 23 wherein in step "e", a blower generates fluid flow in the second vacuum line of between about 8.5 and 42.5 $m^3$ (three hundred and fifteen hundred cubic feet) per minute.

30. The method of claim 23 wherein the vacuum formed within the tank is between about 54200 and 84700 $Nm^{-2}$ (sixteen and twenty-five inches of mercury).

31. A method of removing drilling cuttings from an oil and gas well drilling platform that uses a drill bit supported with a drill string and a well drilling fluid during a digging of a well bore, comprising the steps of:

a) separating drill cuttings from at least a volume of the well drilling fluid on the drilling platform so that a volume of the drilling fluids can be recycled into the well bore during drilling operations;

b) transmitting the cuttings to a collection area on the platform;

c) suctioning the separated drill cuttings with a first suction line having an intake end portion;

d) transmitting the drill cuttings via the first suction line at a flow velocity in excess of 30.5 meters (one hundred feet) per second to a holding tank that has at least one opening for communicating with the tank interior;

e) forming a vacuum within the holding tank interior with a blower that is in fluid communications with the tank interior via a second vacuum line;

f) connecting the holding tank to a floating work boat with a discharge flowline; and g) transmitting cuttings from the tank to the work boat via the flowline.

32. A method for disposing of drill cuttings from an oil and/or gas well drilling platform, comprising:

a) separating said drill cuttings from substantially all of a well drilling fluid in which said drill cuttings have been conveyed from an area being drilled;

b) transporting said drill cuttings to a materials trough;

c) transporting said drill cuttings from said trough via a first suction line to a holding tank using a vacuum; and d) transferring the drill cuttings from the holding tank to an underwater storage tank via a flowline.

33. A method as claimed in claim 32, wherein said drill cuttings are transported directly to said holding tank via a first suction line.

34. A method as claimed in claim 33, wherein a vacuum is generated within the holding tank so that said drill cuttings are transported from said trough to said tank via said first suction line.

35. A method as claimed in claim 32, wherein said vacuum is generated by vacuum-generating means that is in fluid communication with the tank via a second suction line.

36. A method as claimed in claim 32, wherein said holding tank has a screw conveyor therein.

37. A method as claimed in claim 36, wherein a vacuum is generated within said holding tank so that said drill cuttings are transported from said trough to said container via said first suction line and cuttings are emptied from said tank using said screw conveyor.

38. A method as claimed in claim 37, wherein said vacuum is generated by a vacuum-generating means that is in fluid communication with the underwater storage tank via a second suction line.

39. A method as claimed in claim 38, wherein liquid waste and solid waste are removed from said suction line before entering said underwater storage tank.

40. A method as claimed in claim 39, wherein liquid waste and solid waste are removed from the second suction line at a separator that is positioned in fluid communication with the second suction line upstream of the vacuum-generating means.

41. A method as claimed in claim 32, wherein the vacuum generated is in the range of about 54200 to 84700 $Nm^{-2}$ (16 to 25 inches of mercury).

42. A method as claimed in claim 32, wherein the vacuum-generating means generates a fluid flow in the first and second suction lines in the range of about 8.5 to 42.5 $m^3$ (300 to 1500 cubic feet) per minute.

43. A method as claimed in claim 32, wherein said drill cuttings are transported to said underwater storage tank in part through gravity flow.

44. A method as claimed in claim 32, wherein said drill cuttings are transported via said first suction line from the bottom of said trough.

45. A method as claimed in claim 32, wherein the underwater storage tank is ballasted.

46. A method as claimed in claim 32, wherein said drilling fluid is recycled for further use.

47. Apparatus for use in disposing of drill cuttings from an oil and/or gas well drilling platform, comprising:

a) means for separating said drill cuttings from substantially all of a well drilling fluid in which said drill cuttings are carried from the area being drilled;

b) a materials trough to which said drill cuttings are transported;

c) a holding tank on the platform for holding said drill cuttings;

d) an underwater storage tank positioned next to the platform during use;

e) a suction line for transporting said drill cuttings from said trough to said holding tank; and f) a flowline for transferring cuttings from the holding tank to the underwater storage tank.

48. Apparatus as claimed in claim 47, further comprising vacuum-generating means for generating a vacuum within the holding tank so that said drill cuttings are transported from said trough to said tank via said suction line.

49. Apparatus as claimed in claim 48, wherein said vacuum-generating means is in fluid communication with the holding tank via a second suction line.

50. Apparatus as claimed in claim 49, further comprising a separator that is positioned in fluid communication with the second suction line upstream of the vacuum-generating means for removing liquids and solids from the second suction line.

51. Apparatus as claimed in claim 47, wherein the holding tank includes a screw conveyor therein, said first suction line transporting said drill cuttings to said holding tank and said screw conveyor discharging said drill cuttings from said holding tank.

52. Apparatus as claimed in claim 51, further comprising vacuum-generating means for generating a vacuum within the container so that said drill cuttings are transported from said trough to said container via said first suction line.

53. Apparatus as claimed in claim 52, wherein said vacuum-generating means is in fluid communication with the container via a second suction line.

54. A method for removing drill cuttings from an oil and gas well drilling platform that uses a drill bit supported with a drill string and a well drilling fluid during a digging of a well bore, comprising the steps of:

a) separating drill cuttings from the well drilling fluid on the drilling platform so that the drilling fluid can be recycled into the well bore during drilling operations;

b) transmitting the cuttings to a cuttings receptacle on the platform;

c) suctioning the separated drill cuttings from the receptacle with a first suction line having an intake end portion that is positioned at the receptacle;

d) transmitting the drill cuttings via the first suction line to a holding tank that has at least one access opening for communicating with the tank interior;

e) forming a vacuum within the holding tank interior with a blower that is in fluid communication with the tank interior via a second vacuum line; and f) transferring the cuttings from the holding tank to an underwater storage tank using a flowline.

55. The method of claim 54 wherein there are a plurality of holding tanks on the platform.

56. The method of claim 54 wherein the underwater storage tank is ballasted, and further comprising the step of ballasting the underwater storage tank after it is filled with drill cuttings to assist a recovery of the underwater storage tank to the sea surface next to the platform.

57. The method of claim 55 further comprising the step of connecting the holding tanks with a suction manifold.

58. The method of claim 57 further comprising the step of valving the suction manifold to selectively pull a vacuum on a selected tank or tanks.

59. The method of claim 54 wherein liquids and solids are separated from the suction line at the holding tank.

60. The method of claim 54 wherein in step "e", a blower generates fluid flow in the vacuum lines of between about 8.5 and 42.5 $m^3$ (three hundred and fifteen hundred cubic feet) per minute.

61. The method of claim 54 wherein the vacuum formed within the tank is between about 54200 and 84700 $Nm^{-2}$ (sixteen and twenty-five inches of mercury).

62. A method of removing drilling cuttings from an oil and gas well drilling platform that uses a drill bit supported with a drill string and a well drilling fluid during a digging of a well bore, comprising the steps of:

a) separating drill cuttings from at least a volume of the well drilling fluid on the drilling platform so that a volume of the well drilling fluid can be recycled into the well bore during drilling operations;

b) transmitting the cuttings to a collection area on the platform;

c) suctioning the separated drill cuttings from the collection area with a first suction line having an intake end portion;

d) transmitting the drill cuttings via the first suction line to a holding tank;

e) forming a vacuum within the holding tank interior with a blower that is in fluid communications with the tank interior via a second vacuum line;

f) connecting the holding tank to an underwater storage tank with a discharge flowline; and g) transmitting cuttings from the holding tank to the underwater storage tank via the discharge flowline.

63. A method for disposing of drill cuttings from an oil and/or gas well drilling platform, comprising:

a) separating said drill cuttings from substantially all of a well drilling fluid in which said drill cuttings have been conveyed from an area being drilled;

b) transporting said drill cuttings to a materials trough;

c) transporting said drill cuttings from said trough via a first suction line to a container using a vacuum.

64. The method of claim 63, wherein the transportation of drill cuttings to the container occurs substantially continuously over time as a well is drilled.

65. Apparatus for use in disposing of drill cuttings from an oil and/or gas well drilling platform, comprising:

a) means for separating said drill cuttings from substantially all of a well drilling fluid in which said drill cuttings are carried from the area being drilled;

b) a materials trough to which said drill cuttings are transported;

c) a container for holding said drill cuttings; and d) a suction line for transporting said drill cuttings from said trough to said container via a vacuum.

66. The apparatus of claim 65, wherein the transportation of drill cuttings to the container occurs substantially continuously over time as a well is drilled.

* * * * *